United States Patent [19]

Holzle

[11] 4,357,989

[45] Nov. 9, 1982

[54] HEAT EXCHANGE CIRCUIT FOR AN OFFSHORE INSTALLATION

[75] Inventor: Ross G. Holzle, River Ridge, La.

[73] Assignee: Texaco Inc., White Plains, N.Y.

[21] Appl. No.: 182,526

[22] Filed: Aug. 29, 1980

[51] Int. Cl.[3] ..... F28D 15/00

[52] U.S. Cl. ..... 165/45; 114/265

[58] Field of Search ..... 165/45, 47; 62/260; 114/264, 265, 266; 175/9; 9/8 P

[56] References Cited

U.S. PATENT DOCUMENTS

| | | | |
|---|---|---|---|
| 3,766,583 | 10/1973 | Phelps | 9/8 P |
| 3,949,693 | 4/1976 | Bauer et al. | 114/265 |
| 4,026,119 | 5/1977 | Dotti | 9/8 P X |
| 4,134,732 | 1/1979 | Jackson | 114/264 X |
| 4,254,818 | 3/1981 | Melamed | 165/45 |

FOREIGN PATENT DOCUMENTS

| | | | |
|---|---|---|---|
| 636153 | 4/1928 | France | 165/45 |

*Primary Examiner*—Sheldon J. Richter
*Attorney, Agent, or Firm*—Carl G. Ries; Robert A. Kulason; Robert B. Burns

[57] ABSTRACT

An offshore installation, such as a producing platform, includes one or more supporting legs which extend from a working deck downward into the water. Process fluid utilized on the platform is cooled by heat exchange with the surrounding water through indirect contact, or through use of an intermediary fluid which is passed through a cooling circuit made up at least in part by segments of the various water contacting support structures of the platform.

9 Claims, 5 Drawing Figures

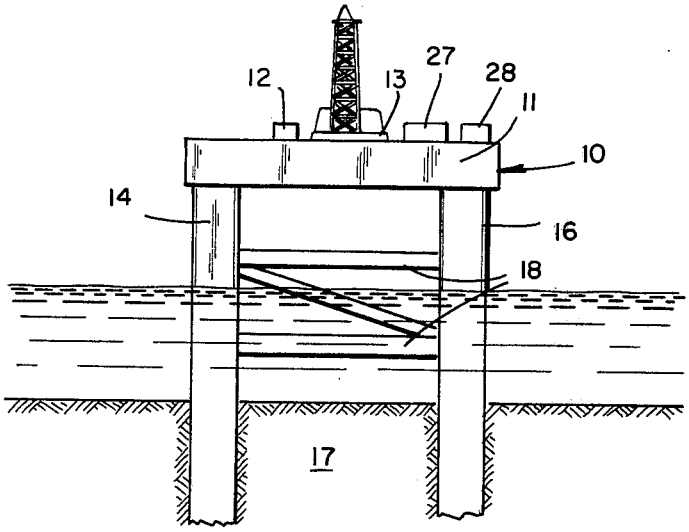
FIG. 1
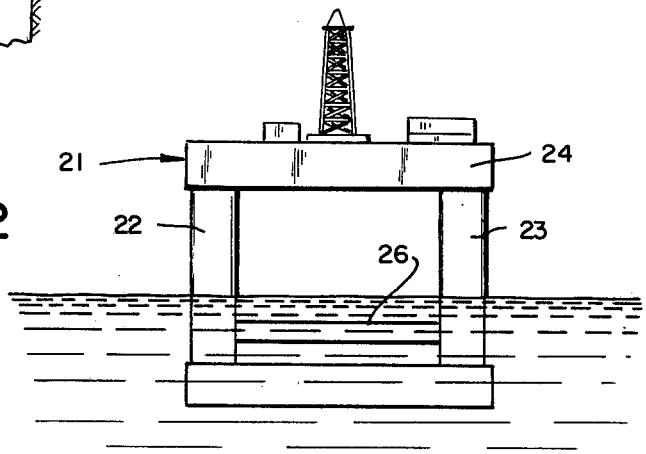
FIG. 2
FIG. 3
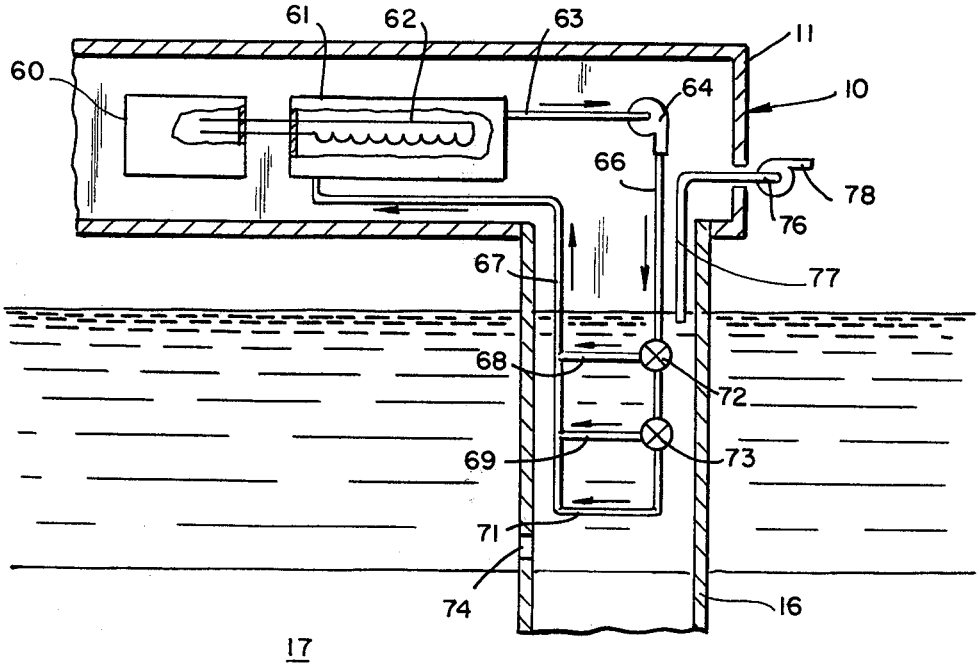

HEAT EXCHANGE CIRCUIT FOR AN OFFSHORE INSTALLATION

BACKGROUND OF THE INVENTION

Offshore production installations such as those used for drilling wells, or merely for producing or processing crude oil and gas, are usually equipped to permit at least some degree of heat exchange with fluids utilized on the platform. Such equipment can be utilized in the actual production operation such as by internal combustion engines which drive the drilling apparatus. It could also include processing equipment which handles and treats produced crude oil and gas.

In either instance the normal practice is to utilize to a large extent heat exchange with the surrounding air for cooling processing fluids. However, air type heat exchangers are generally relatively large in order that the proper exchange rate can be achieved.

On any offshore drilling installation, space is at a premium. Thus, any space occupied by heat exchangers such as those which utilize the air as a heat exchange medium, tend to take up more room than is necessary.

A further disadvantage inherent in the usual air type heat exchanger, is that the temperature of the air utilized to cool the process fluid can rise to the point where relatively little temperature differential exists between the air and fluid. For example, in tropical installations, the air will often exceed 100° F. To achieve any suitable degree of fluid cooling with air of this temperature, an excessive amount of heat exchange surface will be required.

Toward overcoming this problem of cooling a process fluid while utilizing as little deck space as possible, there is presently disclosed means on an offshore platform for efficiently and effectively cooling process fluids. Such means in one embodiment includes a closed circuit which carries an intermediary fluid, preferably a liquid such as water. The latter is circulated into heat exchange contact with both the process fluid, and with the surrounding sea water. Thus, by regulating the volumetric flow of intermediary liquid, it is possible to minimize the amount of on-deck or exposed heat exchange equipment, while achieving the maximum effect of the heat sink capabilities of the surrounding body of water.

It is therefore an object of the invention to provide a heat exchange system for an offshore installation which includes utilization of the surrounding water as a heat sink or heat exchange medium. A further object is to provide a heat exchange system of the type contemplated in which an exemplary degree of temperature control can be effectuated by regulating the amount of heat which is transferred to surrounding waters. A still further object is to provide a relatively simple heat exchange system in which submerged portions of an offshore platform are utilized to avoid the unnecessary utilization of deck space on the platform.

DESCRIPTION OF THE DRAWINGS

FIG. 1 illustrates a fixed offshore platform in which the present invention is embodied.

FIG. 2 illustrates an alternate form of offshore vessel into which the invention is incorporated.

FIG. 3 is a segmentary view in cross section and showing essentially the invention in schematic form.

FIG. 1 illustrates one embodiment of an offshore fixed platform 10 of the type contemplated, which is normally positioned in a body of water. Platform 10 generally includes a deck 11 which holds necessary equipment used for either a drilling operation or the processing of crude oil and gas.

Figure 4:
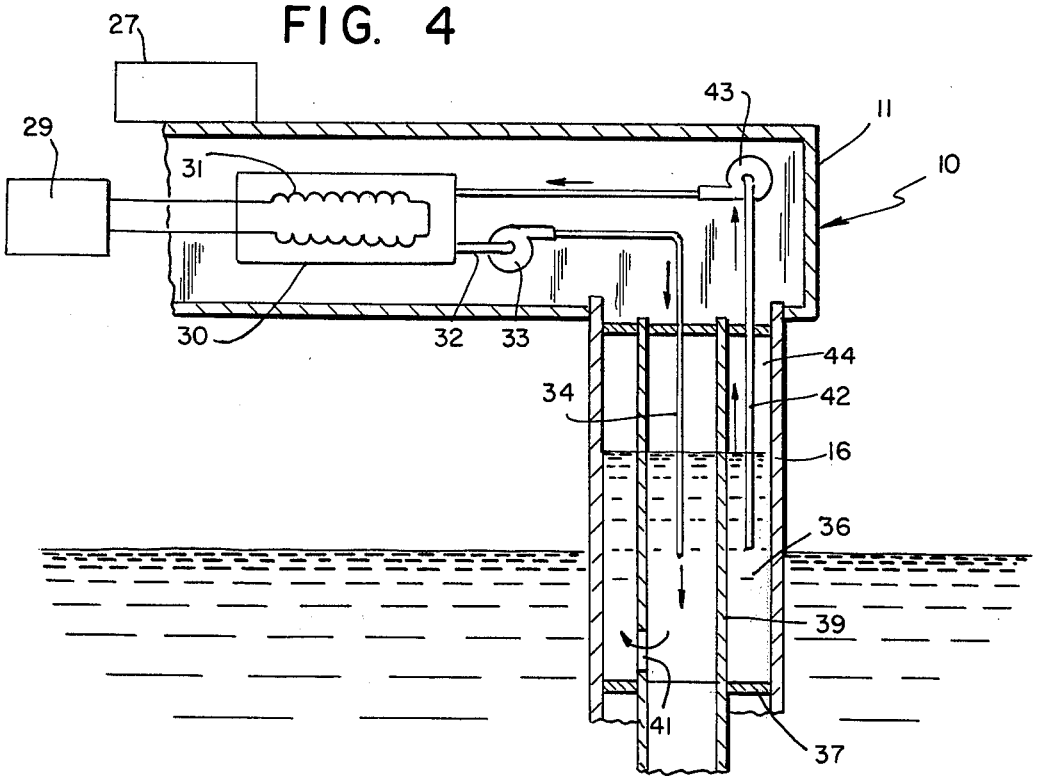
FIGS. 4 and 5 are similar to FIG. 3.

As herein noted, deck 11 embodies equipment which includes an internal combustion engine and ancillary units 12 for driving the main rotary table 13. It also includes equipment for cooling materials such as circulated drilling mud and the like.

In any event, deck 11 is normally positioned above the surface of the water in which platform 10 is located. This elevation of deck 11 is for the purpose of keeping equipment out of the reach of waves and spray which are endemic to offshore installations.

Deck 11 is thus supported by a plurality of downwardly extending platform legs 14 and 16. The latter are normally formed of heavy walled tubular members which fasten to deck 11 and extend downwardly a sufficient distance to be forced into the substrate 17 at the ocean floor.

Support legs 14 and 16 are generally piled into place to provide them with anchoring stability, and to assure platform 10 a firm foundation. While such piles are not here shown, they can be driven internally of the respective legs, or they can be driven external thereto when appropriate guide means is provided on the leg structure.

Platform 10 is further provided with any number of intermediate bracing members 18 such as tubular beams or the like which extend transversely of the legs 14 and 16, thereby connecting the latter into a relatively rigid unit. Transverse members 18 are normally positioned along the respective legs at suitable intervals to provide necessary structural strength.

Said transverse bracing members 18 can thereby be located beneath the water's surface, as well as above the water. In relatively deep waters there will understandably be a number of such submerged reinforcing braces to provide the overall unit with desired rigidity, and lateral stability.

FIG. 2 illustrates another form of drilling platform or vessel 21. The latter is used in the floating mode for drilling and/or receiving crude products rather than being firmly fastened to the ocean floor.

In such a unit, the entire rig 21 is controllably floatable. Thus, the respective legs 22 and 23 which support deck 24, as well as the cross members 26 which support the legs, are all provided with internal controlled buoyancy means. The floating rig can be self propelled or towed between drilling locations, and thereafter anchored in place rather than being fixed.

In the instance of either fixed platform 10 or floating rig 21, there will be a considerable amount of the structure exposed to and in contact with surrounding water. This water in a normal offshore situation, is such that it will function as a massive heat sink used for absorbing heat from process fluids.

In the schematic arrangement shown in FIG. 4, which is utilized for illustrating the invention, offshore structure 10 includes a processing unit 27 which is carried on deck 11. In this unit, a source of process fluid is provided in the form of a circulated gas, an appropriate fluid, or even fresh water.

It is appreciated that the particular process fluid utilized will depend on the function being carried out at the installation. For convenience, the process fluid will be herein considered as a circulating liquid which is utilized in one or more processes in which the fluid functions to accumulate heat. The process fluid is thereafter passed to a process fluid reservoir 29.

From the latter, process fluid is conducted through a cooling circuit which brings it into heat exchange relationship with surrounding sea water. The latter can be through direct contact; preferably heat exchange is made through the facility of the intermediary liquid.

Referring again to FIG. 4, this segmentary view is taken from the platform shown in FIG. 1. In one embodiment of the disclosed cooling system leg 16 which depends downwardly from and supports deck 11, is disposed in the surrounding sea water and buried in at its lower end in substrate 17. Reservoir 29, holding a source of process fluid is shown as being positioned within the confines of deck 11.

It is appreciated that the source of process fluid can be embodied in any form of receptacle or container. Further, it can comprise a pipeline, conduit or the like which cooperates with the processing unit to carry the heat transfer liquid.

The process fluid is thereafter introduced to reservoir or heat exchanger 30 by way of a tube, coil or other heat exchange element.

Heat transfer between the process liquid and the intermediate fluid can be achieved in any number of suitable heat exchangers presently known. Since the intermediate heat exchange fluid is preferably water or a similar inexpensive available liquid, it is contained within a receptacle, shell or like unit 30 within which the first heat exchanger coils 31 are immersed. Intermediate fluid is conducted through a first line 32 to a circulating pump 33 and thence into the leg 16.

Leg 16 is formed of sufficiently heavy metal to afford it structural capabilities to maintain deck 11 above water level. The leg is provided internally with an elongated caisson or similar pipe-like structure 39 which extends substantially the length of leg 16 and can be likewise embedded at its lower end in the substrate, as is the leg.

Normally, internal casing 39 can take the form of a pile which is driven into substrate 17 after the leg 16 is jetted or lowered into place. Thereafter, with the pile 39 so embedded, the pile and the leg are united at a concrete plug 37 by grouting which is introduced to the annulus 36 formed between said two members.

Annular plug 37 is thereafter utilized in the present arrangement to define a floor to holding reservoir 36. Reservoir 36 receives a stream of the intermediate water after the latter has been introduced to caisson 39 by way of circulating pump 33 and elongated discharge conduit 34.

One or more openings such as 41 formed at the lower end of caisson 39 permit the intermediate liquid to pass outwardly into annular passage 36. In the latter the liquid comes into contact with the relatively cool walls of leg 16 which are exposed to and in direct contact with surrounding sea water.

To remove the intermediate water from the annulus 36 an elongated conduit 42 extends into said annulus 36 and is connected to the inlet of a return pump 43. The latter carries a stream of cooled water back into heat exchange contact with process fluid within shell 30. A closure means 44 formed at the upper end of leg 16 and caisson 39, provides a cover to the upper end of annulus 36.

What is provided then is a closed circuit for intermediate liquid which is comprised primarily of the sump or water contained within caisson 39, and which can constitute a relatively large mass or volume of water. The combined caisson 39, and the annular cooler passage 36, thus provide a sump which is capable of holding varying amounts of the intermediate water depending on the amount thereof to be circulated.

It is appreciated that the present diagram illustrates the primary features of the circulatory system including the reservoir 29 as well as the circulating return pumps. It is understood, that additional valving, meters and the like will further be included in the closed circuit such that the rate of circulation and its cooling capability can be controlled.

Figure 5:
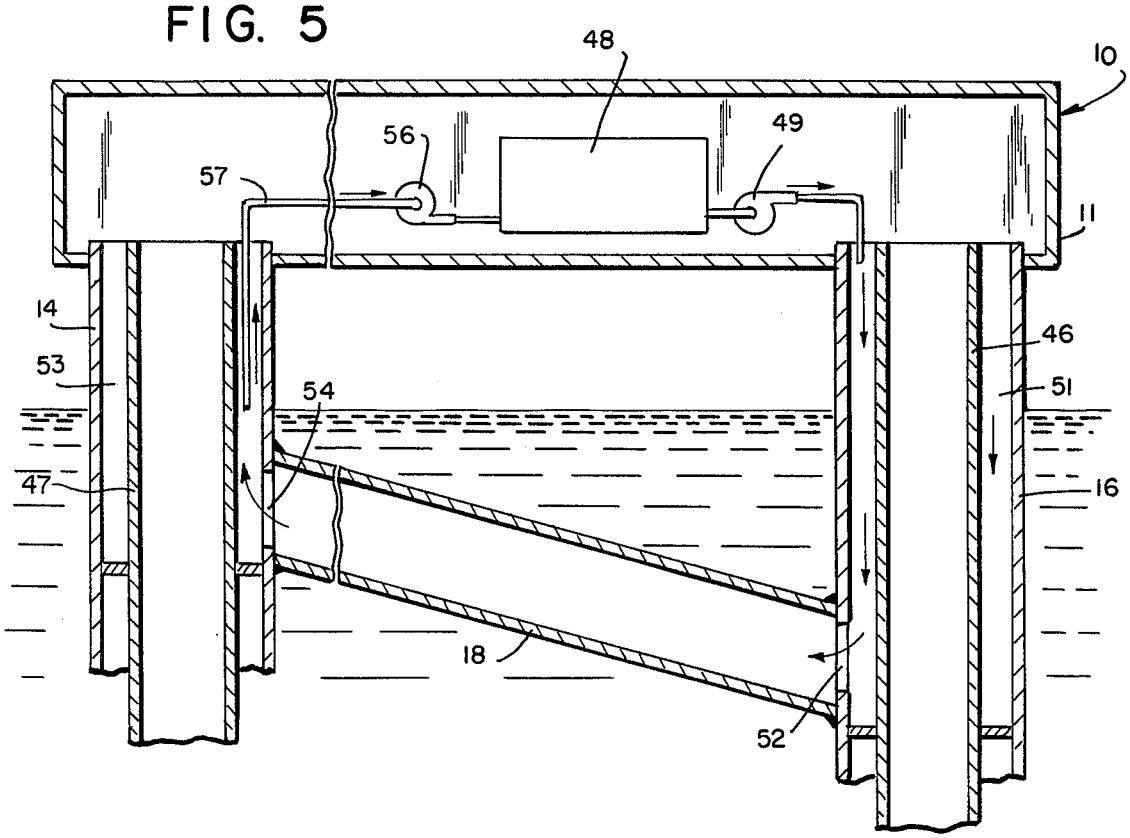

In an alternate embodiment of the invention shown in FIG. 5, reference is again made to FIG. 1 which illustrates stationary platform 10 embodying the downwardly depending supporting legs 14 and 16. In the present arrangement, use is made of not only the two supporting legs 14 and 16 which are submerged at their lower ends in the water, but also of support member 18 which extends between the two legs.

Each leg 14 and 16, is provided with an elongated caisson 46 and 47. The caisson as hereinabove mentioned, can constitute an elongated pile or merely a cylindrical caisson element disposed longitudinally within the leg interior. In either event, each leg 14 and 16, provides an annulus formed between the leg and the caisson. Thus, liquid introduced to the annulus will be brought into heat exchange contact with the surrounding water by the immersed support leg.

As in the previous example, each leg annulus includes a lower concrete plug, or similar seal member to define a floor to the annulus lower end.

After water has been conducted from fluid reservoir 48 by circulating pump 49, the intermediary water is deposited in first annulus 51. After initial contact with the wall of leg 16, the water flows through connecting opening 52 and into support member 18. In the latter, the water is further cooled by heat exchange with surrounding water, and enters annulus 53 by way of discharge port 54. It is thereafter further cooled by heat exchange with the walls of the support leg 14. The cooled water now accumulates in annulus 53.

A return pump 56 having its inlet 57 communicated with the water in annulus 53, lifts the now cooled water into reservoir 48.

In both the instances herein described, the intermediary water contained within the respective reservoirs can be maintained at a desired temperature. Thus, the temperature of process fluid within coils 31 of FIG. 4, can likewise be regulated to a desired range by altering the flow rate through the cooling circuit.

Since the flow of process fluid may vary depending on the conditions under which it is operating, it is desirable that adequate controls be maintained over the cooling step. Thus, the temperature of process fluid can be readily controlled as a function of cooling water flow through the platform members.

In a still a further embodiment of the invention, as shown in FIG. 3, process water from reservoir 60 is introduced to reservoir 61 and passes through coils or tube bundles or coils 62 contained in the latter. Reservoir 61 is provided with a sufficient amount of intermediate cooling water which can be temperature controlled or caused to contact the process water coils whereby to regulate the temperature of the latter.

Cooling of intermediate water is achieved by passing the latter through a line 63 to a circulating pump 64 and thence downward into leg 16. Support leg 16 encloses a closed circuit comprising primarily a downward header 66 which is communicated with an upward segment or header 67. Both segments 66 and 67 are communicated by a plurality of cross branches 68, 69 and 71.

Each cross branch defines a separate circuit which is regulated by a flow control valve 72 and 73. Said valves are remotely operable to adjust the flow of fluid through the enlongated header 66 and into the upward header 67. Thus, the water flow is maintained in heat exchange contact with reservoir water within leg 16 for varying periods of time by adjusting the length of the cooling circuit.

For example, water which is initially passed downward, will, if both the control valves 73 and 72 are open, flow the full circuit and pass through the upward header 67, and thence be returned to reservoir 61.

However, to further regulate the temperature of water within reservoir 61, the respective control valves 72 and 73 can be remotely actuated such that flow will pass through either of the cross branches 68 or 69. This shortens the actual path through which the cooling process takes place.

To further regulate the temperature of reservoir 61 water, leg 16 is provided with an inlet 74 which permits entrance of sea water to the leg interior. As the water is heated by contact with the intermediate cooling circuit, the sea water will rise through the leg.

A further form of temperature control means within leg 16 resides in pump 76. The latter is connected at its inlet with a conduit 77 which extends into the sea water pool within leg 16. Pump 76 is located to discharge its flow back into the ocean through discharge port 78.

Thus, by regulating sea water flow through leg 16, it is possible to control the rate of heat exchange between intermediate water in the cooling circuit, and sea water.

Other modifications and variations of the invention as hereinbefore set forth can be made without departing from the spirit and scope thereof, and therefore, only such limitations should be imposed as are indicated in the appended claims.

I claim:

1. System for treating a process fluid at an offshore structure positioned in a body of water, and having at least one support member of said structure disposed in said body of water to maintain the structure's deck above the water's surface, and including;

first heat exchange means which is communicated with a source of said process fluid to circulate a stream of the latter, second heat exchange circuit disposed in heat exchange contact with said first heat exchange means, and circulating a stream of intermediate heat transfer fluid and second heat exchange means communicated with said stream of intermediate heat transfer fluid being in heat exchange relation with said body of water.

2. In a system as defined in claim 1, wherein said second heat exchange circuit includes at least one pump means operable to urge said intermediate fluid through the circuit.

3. In a system as defined in claim 1, wherein said second heat exchange circuit includes a segment thereof disposed within said support member to contact the water within the latter.

4. In a system as defined in claim 1, wherein said second heat exchange means is variable to alter the degree of heat exchange surface between intermediate fluid and the body of water.

5. In a system as defined in claim 1, wherein said second heat exchange circuit contains a heat transfer liquid.

6. In a system as defined in claim 5, wherein the heat transfer liquid is water.

7. In a system as defined in claim 1, wherein said second heat exchange circuit includes a plurality of branches, and valve means operable to regulate said flow of heat transfer fluid through the respective branches.

8. In a system as defined in claim 1, wherein said offshore structure includes an elongated support leg, a caisson disposed longitudinally of said leg defining an annular passage which is communicated with said second heat exchange circuit.

9. In a system as defined in claim 1, wherein said offshore structure includes a plurality of elongated support legs, at least one transverse member extending between the support legs and communicated with the latter to define said second heat exchange circuit.

* * * * *